US010411355B2

(12) United States Patent
Suzuki

(10) Patent No.: US 10,411,355 B2
(45) Date of Patent: Sep. 10, 2019

(54) ANTENNA DEVICE

(71) Applicant: ALPS ALPINE CO., LTD., Tokyo (JP)

(72) Inventor: Tomotaka Suzuki, Miyagi (JP)

(73) Assignee: ALPS ALPINE CO., LTD., Tokyo (JP)

( * ) Notice: Subject to any disclaimer, the term of this patent is extended or adjusted under 35 U.S.C. 154(b) by 1 day.

(21) Appl. No.: 15/910,213

(22) Filed: Mar. 2, 2018

(65) Prior Publication Data

US 2018/0191070 A1 Jul. 5, 2018

Related U.S. Application Data

(63) Continuation of application No. PCT/JP2016/080867, filed on Oct. 18, 2016.

(30) Foreign Application Priority Data

Oct. 26, 2015 (JP) ..... 2015-209786

(51) Int. Cl.
*H01Q 1/32* (2006.01)
*H01Q 9/04* (2006.01)
(Continued)

(52) U.S. Cl.
CPC ..... *H01Q 9/045* (2013.01); *H01Q 1/36* (2013.01); *H01Q 1/38* (2013.01); *H01Q 9/0421* (2013.01); *H01Q 13/16* (2013.01); *H01Q 1/3275* (2013.01)

(58) Field of Classification Search
CPC ..... H01Q 1/38; H01Q 1/36; H01Q 1/3275; H01Q 9/045; H01Q 9/0421; H01Q 13/16
See application file for complete search history.

(56) References Cited

U.S. PATENT DOCUMENTS 6,448,932 B1 * 9/2002 Stoiljkovic ..... H01Q 1/243 343/700 MS
6,448,933 B1 9/2002 Hill et al.
(Continued)

FOREIGN PATENT DOCUMENTS

EP 1933416 6/2008
JP H05-037229 2/1993
(Continued)

OTHER PUBLICATIONS

International Search Report dated Nov. 29, 2016 in PCT/JP2016/080867 filed on Oct. 18, 2016.
(Continued)

*Primary Examiner* — Hoang V Nguyen
*Assistant Examiner* — Awat M Salih
(74) *Attorney, Agent, or Firm* — IPUSA, PLLC

(57) ABSTRACT

An antenna device is provided with a plate-shaped grounded wiring board, a plate-shaped antenna element arranged to oppose the wiring board and spaced apart therefrom, two grounding leg parts which are disposed at ends of the antenna element and each of which has an extending tip connected to the wiring board, and a feeding leg part which is disposed at an end of the antenna element and which has an extending tip that connects to a transmission circuit or a reception circuit. A planar shape formed by the ends at which the plurality of grounding leg parts are disposed and the end at which the feeding leg part is disposed has point symmetry.

7 Claims, 10 Drawing Sheets

(51) Int. Cl.

| | |
|---|---|
| ***H01Q 1/38*** | (2006.01) |
| ***H01Q 13/16*** | (2006.01) |
| ***H01Q 1/36*** | (2006.01) |

(56) References Cited

U.S. PATENT DOCUMENTS

| | | | | |
|---|---|---|---|---|
| 7,123,197 | B2 | 10/2006 | Suzuki | |
| 7,183,985 | B2 | 2/2007 | Tseng | |
| 7,304,611 | B2 | 12/2007 | Yuanzhu | |
| 2003/0107881 | A1 | 6/2003 | Muramatsu et al. | |
| 2004/0217910 | A1 | 11/2004 | Montgomery et al. | |
| 2005/0099340 | A1* | 5/2005 | Suzuki ..... | H01Q 1/3233 343/700 MS |
| 2014/0028512 | A1 | 1/2014 | Lindenmeier et al. | |

FOREIGN PATENT DOCUMENTS

| | | |
|---|---|---|
| JP | H09-153730 | 6/1997 |
| JP | 2003-188620 | 7/2003 |
| JP | 2006-135773 | 5/2006 |
| JP | 2008-219578 | 9/2008 |

OTHER PUBLICATIONS

Extended European Search Report for 16859640.1 dated Aug. 28, 2018.
European Office Action for 16859640.1 dated Jul. 29, 2019.

* cited by examiner

ANTENNA DEVICE

CROSS-REFERENCE TO RELATED APPLICATIONS

This application is a continuation application filed under 35 U.S.C. 111(a) claiming the benefit under 35 U.S.C. 120 and 365(c) of a PCT International Application No. PCT/JP2016/080867 filed on Oct. 18, 2016, which is based upon and claims the benefit of priority of the prior Japanese Patent Application No. 2015-209786 filed on Oct. 26, 2015, the entire contents of which are incorporated herein by reference.

BACKGROUND OF THE INVENTION

1. Field of the Invention

The present invention relates to an antenna device.

2. Description of the Related Art

Recently, a configuration is popularly used in which communication is performed by mounting an antenna device on a rooftop of an automobile. In an application in which communication is made from the automobile to ground infrastructure, a vertical polarization monopole type or dipole type antenna that is often used has a nondirectional directivity in a horizontal plane.

The monopole type or dipole type antenna normally requires an antenna height of approximately $\lambda/4$ to $\lambda/2$, and thus, the height of an outer casing increases. For example, in a case of an antenna in a 5.9 GHz band, the height of the outer casing is approximately 12 mm. In addition, due to the shape of the antenna, it is difficult for the antenna to stand by itself and the shape of the antenna is unstable. For this reason, the antenna requires a holding member in most cases.

On the other hand, Japanese Laid-Open Patent Publication No. 2006-135773, for example, proposes a thin antenna device that operates as a vertical polarization antenna that is nondirectional with respect to an azimuth. More particularly, a pair of plate-shaped conductors oppose each other, and an opening partitioned by connecting conductors on the right and left is formed between peripheral edge parts of the pair of plate-shaped conductors. Because a field distribution within the opening at a time of feeding power is similar to that of a slot antenna, the vertical polarization is radiated towards a front of the opening.

There are also demands to further reduce the size of antenna devices. According to the antenna device proposed in Japanese Laid-Open Patent Publication No. 2006-135773, a current at a top surface part is canceled in a complicated manner. Because the antenna device operates similarly to the slot antenna, at least a size of approximately 20×20×4 mm (1600 $mm^2$) needs to be secured in order to obtain sufficient radio reception, and for this reason, it is difficult to sufficiently reduce the size of the antenna device.

SUMMARY OF THE INVENTION

Embodiments of the present invention are conceived in view of the above circumstances, and one object according to embodiments of the present invention is to provide an antenna device that can further reduce the size of a nondirectional vertical polarization antenna.

According to one aspect of the embodiments of the present invention, an antenna device includes a plate-shaped antenna element arranged to oppose a wiring board that is grounded, with a gap formed therebetween, a plurality of grounding leg parts arranged at end parts of the antenna element and having respective extending tips connected to the wiring board, and a feeding leg part arranged at an end part of the antenna element and having an extending tip that connects to a transmission circuit or a reception circuit, wherein a plane famed by the end parts where the plurality of grounding leg parts are arranged, and the end part where the feeding leg part is arranged, is point symmetrical.

Other objects and further features of the present invention may be apparent from the following detailed description when read in conjunction with the accompanying drawings.

DESCRIPTION OF THE PREFERRED EMBODIMENTS

Figure 1:
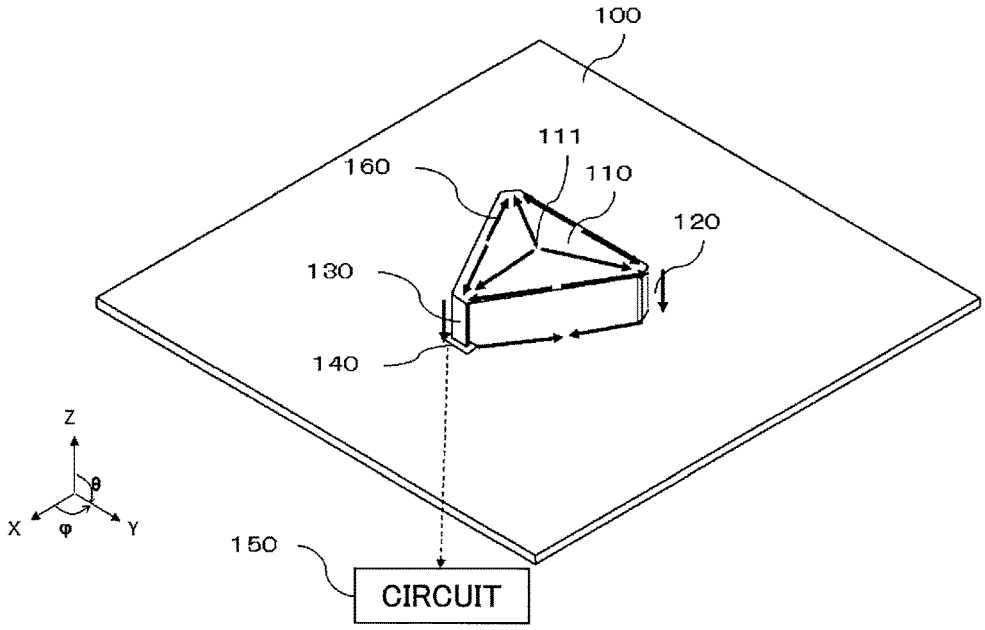
FIG. 1 is a diagram for explaining an antenna device in one embodiment of the present invention having a triangular shape when viewed from a top surface.

FIG. 1 is a diagram for explaining an antenna device in one embodiment of the present invention having a triangular shape when viewed from a top surface. The antenna device having the triangular shape illustrated in FIG. 1 has a plate-shaped wiring board 100 that is grounded, a plate-shaped antenna element 110 that is arranged to oppose the wiring board 100 with a gap formed therebetween, 2 grounding leg parts 120 arranged at end parts of the antenna element 110 and having respective extending tips connected to the wiring board 100, and a feeding leg part 130 arranged at an end part of the antenna element 110 and having an extending tip that connects to a circuit (transmission circuit or reception circuit) 150.

The antenna element 110 is planar and plate-shaped when viewed from a top surface (upper surface) and when viewed from a bottom surface (lower surface). The top surface and the bottom surface have the same shape, and a thickness between the top surface and the bottom surface is constant. The top surface and the bottom surface of the antenna element 110 have a point symmetrical shape about a center point 111, which is a regular polygonal shape. In the example illustrated in FIG. 1, the top surface and the bottom surface of the described antenna element 110 have a regular triangular shape.

Because the top surface of the antenna element 110 has the regular triangular shape, the top surface has 3 vertexes. In the example illustrated in FIG. 1, these 3 vertexes are described as end parts. The shape that is formed by connecting these 3 vertexes, that is, the end parts, is the point symmetrical shape which is the regular polygonal shape. In the example illustrated in FIG. 1, the shape that is formed by connecting the vertexes is the same as the shape of the top surface of the antenna element 110, which is the regular triangular shape.

The 2 grounding leg parts 120 are arranged at 2 end parts of the antenna element 110, that is, at 2 of the 3 vertexes of the antenna element 110. Each of the 2 grounding leg parts 120 extends vertically in a normal direction from the top surface and the bottom surface of the antenna element 110, and the extending tip thereof connects to the wiring board 100. Each of the 2 grounding leg parts 120 also extends vertically in the normal direction with respect to the wiring board 100, and the extending tip thereof connects to the wiring board 100.

The feeding leg part 130 is arranged at 1 end part of the antenna element 110, that is, at 1 remaining vertex of the 3 vertexes of the antenna element 110. The feeding leg part 130 extends vertically in the normal direction from the top surface and the bottom surface of the antenna element 110, and the extending tip thereof extends vertically in the normal direction towards the wiring board 100. A hole 140 is formed in the wiring board 100 at a part to which the feeding leg part 130 extends, and the feeding leg part 130 passes through the surface of the wiring board 100 so as not to make contact with a grounding part of the wiring board 100.

The feeding leg part 130 finally connects to the circuit (transmission circuit or reception circuit) 150. A surface formed by the end parts where the plurality of grounding leg parts 120 are arranged, and the end part where the feeding leg part 130 is arranged, is point symmetrical. Power from the circuit 150 is fed to the antenna device via a feeding line.

When power is fed to the antenna device in the grounded state described above, current flows along arrows illustrated in FIG. 1. As a result of feeding power, the current flows from a gravitational center part of the top surface of the antenna element 110 towards each vertex. In addition, the current flows from a center of three sides of the top surface towards each vertex. Hence, the current flows towards each vertex, and the current from each vertex flows through each leg part towards the wiring board 100. The current that reaches the wiring board 100 flows on the wiring board 100 in a direction opposite to the direction in which the current flows on the top surface of the antenna element 110.

Figure 2:
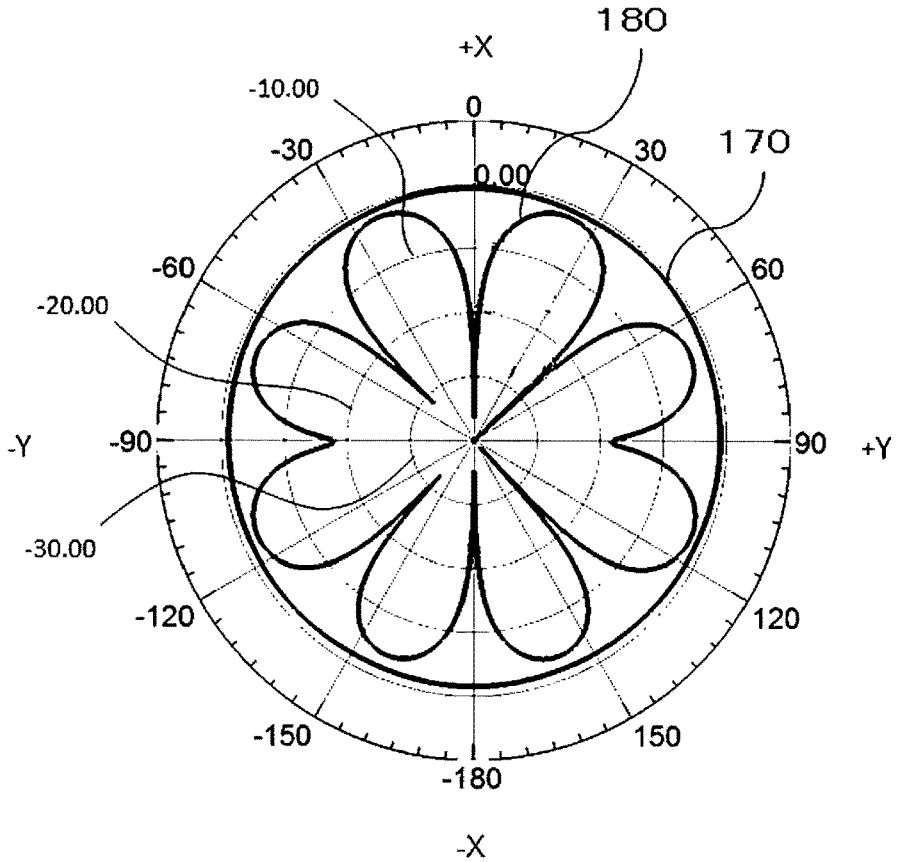
FIG. 2 is a diagram for explaining a radiation characteristic of the antenna device in one embodiment of the present invention having the triangular shape when viewed from the top surface.

In the antenna device illustrated in FIG. 1, a deformed loop antenna having an opening of approximately λ/2 in 3 directions is formed by the antenna element 110, and the vertical polarization antenna device having the nondirectional radiation characteristic has a low profile and can stand by itself. The antenna device basically operates as a loop antenna of approximately 1λ, and the nondirectional radiation characteristic can be obtained by arranging the 2 grounding leg parts 120 connecting the top surface of the antenna element 110 and the wiring board 100, and the feeding leg part 130 in point symmetry. FIG. 2 is a diagram for explaining the radiation characteristic of the antenna device in one embodiment of the present invention having the triangular shape when viewed from the top surface. A waveform 170 indicates the vertical polarization, and a waveform 180 indicates a horizontal polarization.

In the case of an antenna operating at 5.9 GHz, for example, a volume forming an antenna element may be determined by the regular triangle having a side of 17.3 mm and forming the antenna element 110, and each leg part having a height of 4.5 mm. In a conventional structure provided with a feeding part at a center of a top surface part of an antenna element, one side needs to be approximately 20 mm. Hence, the size of the antenna device can be reduced compared to the conventional structure of the antenna device, and size reduction of approximately 38% is possible. A relationship of the side, the height, and the wavelength is desirably set to satisfy horizontal+vertical=λ/2.

Figure 3:
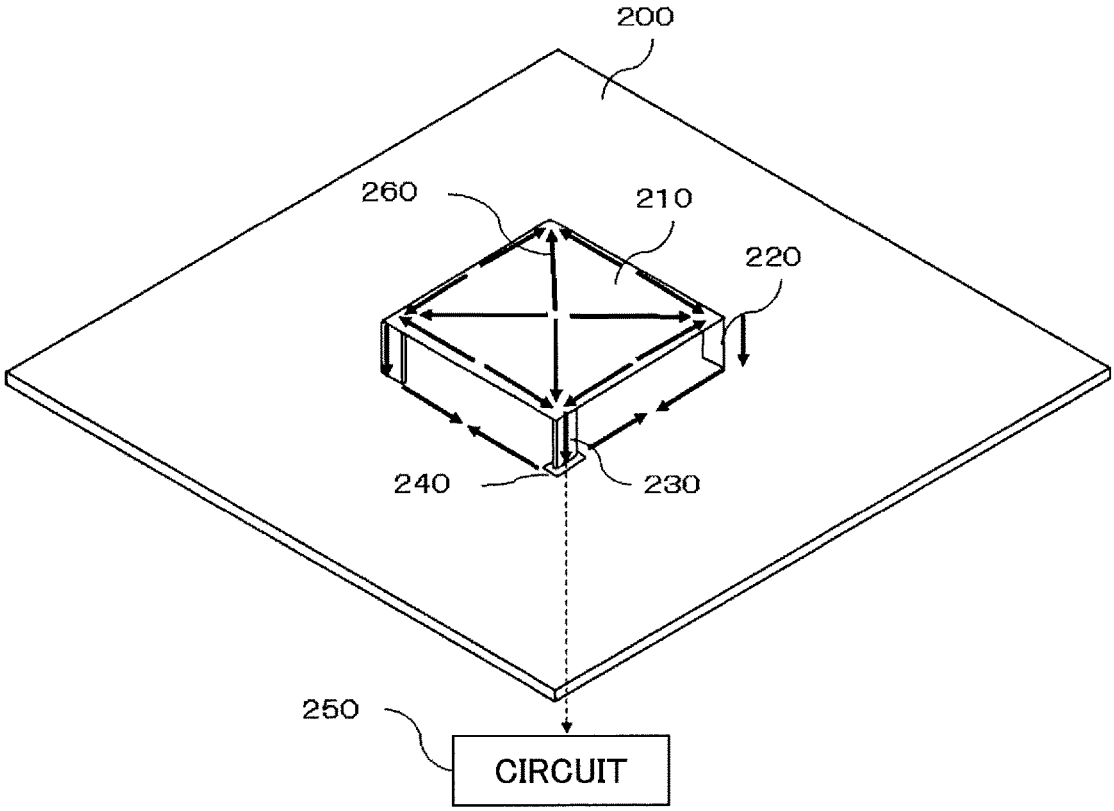
FIG. 3 is a diagram for explaining an antenna device in one embodiment of the present invention having a square shape when viewed from the top surface.

FIG. 3 is a diagram for explaining an antenna device in one embodiment of the present invention having a square shape when viewed from the top surface. FIG. 3 illustrates an example in which the regular triangular shape of the top surface and the bottom surface of the antenna device illustrated in FIG. 1 is replaced by the square shape. The antenna device having the square shape illustrated in FIG. 3 has a plate-shaped wiring board 200 that is grounded, a plate-shaped antenna element 210 that is arranged to oppose the wiring board 200 with a gap famed therebetween, 3 grounding leg parts 220 arranged at end parts of the antenna element 210 and having respective extending tips connected to the wiring board 200, and a feeding leg part 230 arranged at an end part of the antenna element 210 and having an extending tip that connects to a circuit 250.

Because the top surface of the antenna element 210 has the square shape, the top surface has 4 vertexes. In the example illustrated in FIG. 3, these 4 vertexes are described as end parts. In the example illustrated in FIG. 3, the shape that is formed by connecting the 4 vertexes, that is, the end parts, is the same as the shape of the top surface of the antenna element 210, which is the square shape.

The 3 grounding leg parts 220 are arranged at 3 end parts of the antenna element 210, that is, at 3 of the 4 vertexes of the antenna element 210. Each of the 3 grounding leg parts 220 extends vertically in a normal direction from the top surface and the bottom surface of the antenna element 210, and the extending tip thereof connects to the wiring board 200. Each of the 3 grounding leg parts 220 also extends vertically in the normal direction with respect to the wiring board 200, and the extending tip thereof connects to the wiring board 200.

The feeding leg part 230 is arranged at 1 end part of the antenna element 210, that is, at 1 remaining vertex of the 4 vertexes of the antenna element 210. The feeding leg part 230 extends vertically in the normal direction from the top surface and the bottom surface of the antenna element 210, and the extending tip thereof extends vertically in the normal direction towards the wiring board 200. A hole 240 is famed in the wiring board 200 at a part to which the feeding leg part 230 extends, and the feeding leg part 230 passes through the surface of the wiring board 200 so as not to make contact with a grounding part of the wiring board 200. The feeding leg part 230 finally connects to the circuit (transmission circuit or reception circuit) 250. Power from the circuit 250 is fed to the antenna device via a feeding line.

When power is fed to the antenna device in the grounded state described above, current flows along arrows illustrated in FIG. 3. As a result of feeding power, the current flows from a gravitational center part of the top surface of the antenna element 210 towards each vertex. In addition, the current flows from a center of four sides of the top surface towards each vertex. Hence, the current flows towards each vertex, and the current from each vertex flows through each leg part towards the wiring board 200. The current that reaches the wiring board 200 flows on the wiring board 200 in a direction opposite to the direction in which the current flows on the top surface of the antenna element 210.

Figure 4:
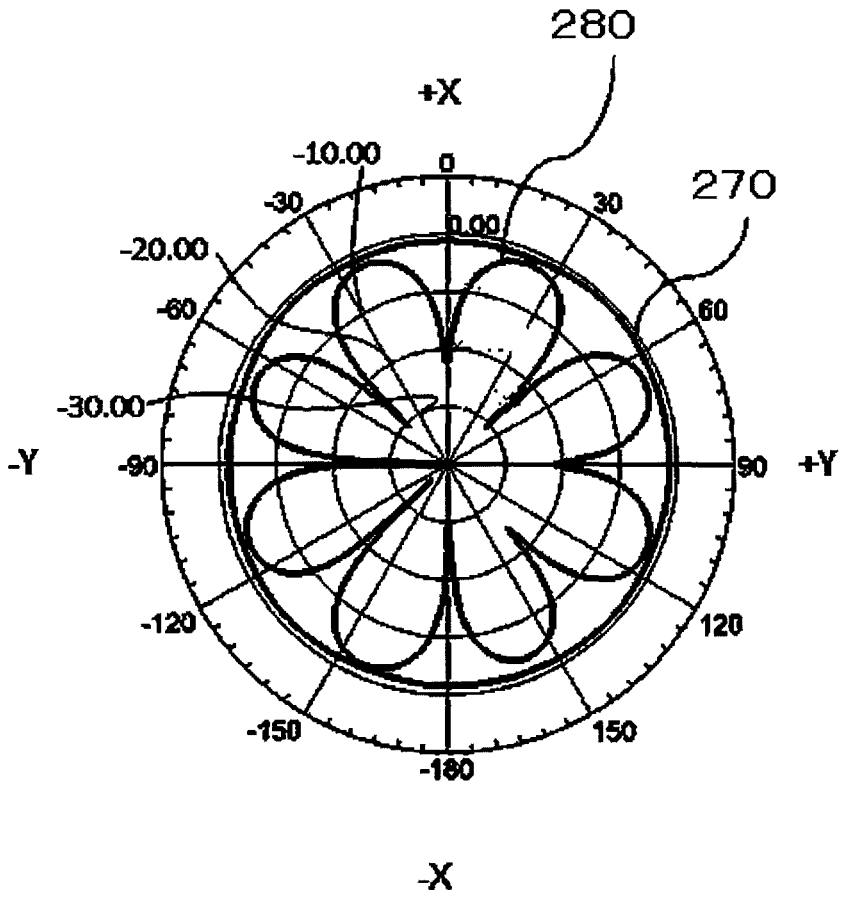
FIG. 4 is a diagram for explaining a radiation characteristic of the antenna device in one embodiment of the present invention having the square shape when viewed from the top surface.

The antenna device illustrated in FIG. 3 also basically operates as a deformed loop antenna of approximately 1λ, and the vertical polarization antenna device having the nondirectional radiation characteristic can be obtained similarly as in the case of FIG. 1. FIG. 4 is a diagram for explaining the radiation characteristic of the antenna device in one embodiment of the present invention having the square shape when viewed from the top surface. A waveform 270 indicates the vertical polarization, and a waveform 280 indicates a horizontal polarization.

In the case of an antenna operating at 5.9 GHz, for example, a volume forming an antenna element may be determined by the square having a side of 17 mm and forming the antenna element 210, and each leg part having a height of 4 mm. The size of the antenna device can be reduced compared to the conventional structure of the antenna device.

In the examples illustrated in FIG. 1 and FIG. 3, the antenna element 110 is described as having the regular triangular shape and the antenna element 210 is described as having the square shape. However, the antenna elements may have various shapes within a range of regular polygonal shapes. In addition, since the point symmetrical structure is used to perform the loop operation by the current distribution, the point symmetrical structure is not limited to the regular polygonal shape, and the antenna device may have a circular shape, for example. In addition, the antenna element 110 and the antenna element 210 do not necessarily have to be planar, and the antenna element 110 and the antenna element 210 may have a curved structure as long as the point symmetrical structure is maintained.

Figure 5:
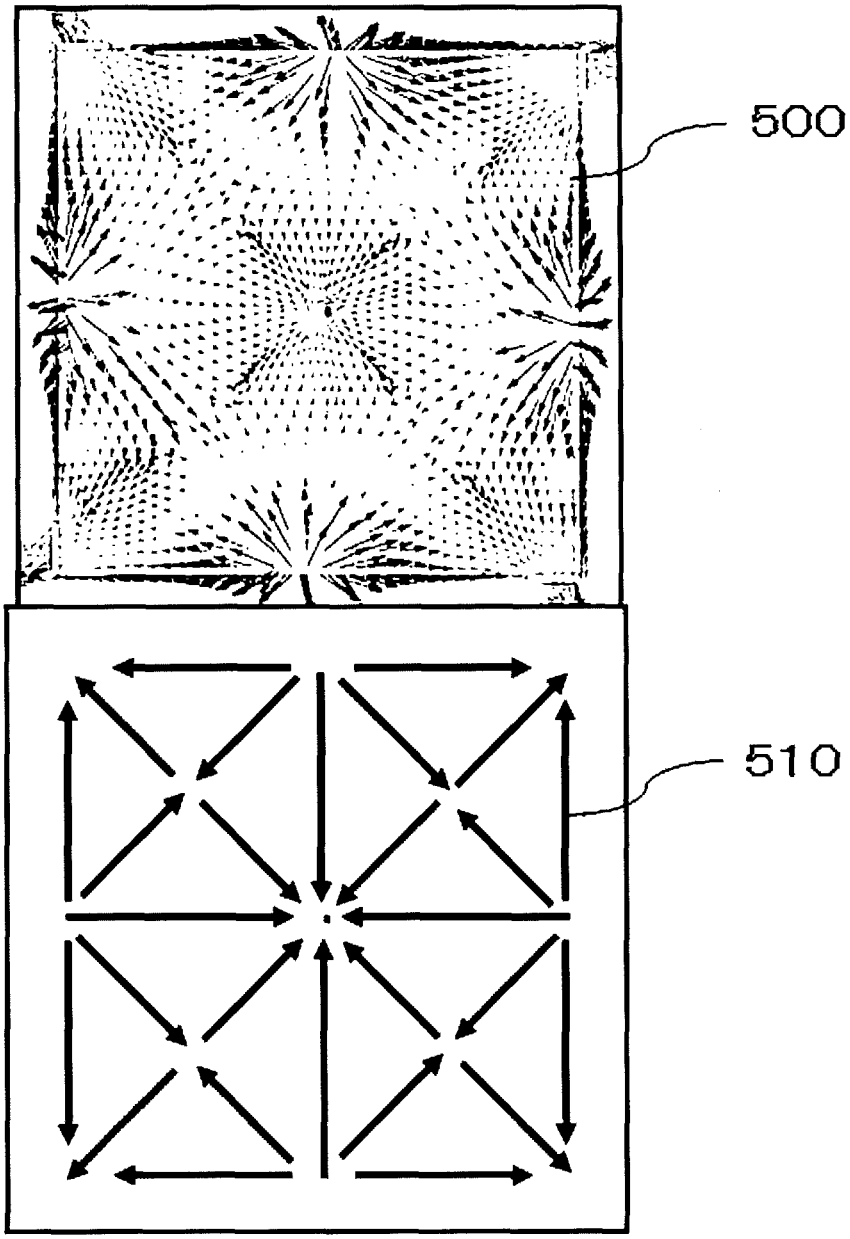
FIG. 5 is a diagram illustrating a current distribution of a top surface part in a case of an embodiment categorized into a slot antenna.

FIG. 5 is a diagram illustrating the current distribution of the top surface part in a case of an embodiment categorized into a slot antenna. Before describing the current distribution for the case in which the current flows in the antenna device having the structure illustrated in FIG. 3, a description will be given of an example of a case in which a feeding part is provided on the top surface part and the 4 leg parts are grounded. In the case of this conventional structure, the current at the top surface part is canceled in a complicated manner, as illustrated by a distribution 500 in FIG. 5, and a size of a side surface opening (slot) exhibits a dependence on an operating frequency. As a result, the current distribution is clustered at a central part and end parts of the distribution. More particularly, as illustrated by a distribution 510, parts where arrows strengthen each other and parts where arrows cancel each other are generated. The magnitude of the current is canceled at the parts where the arrows cancel each other.

Figure 6:
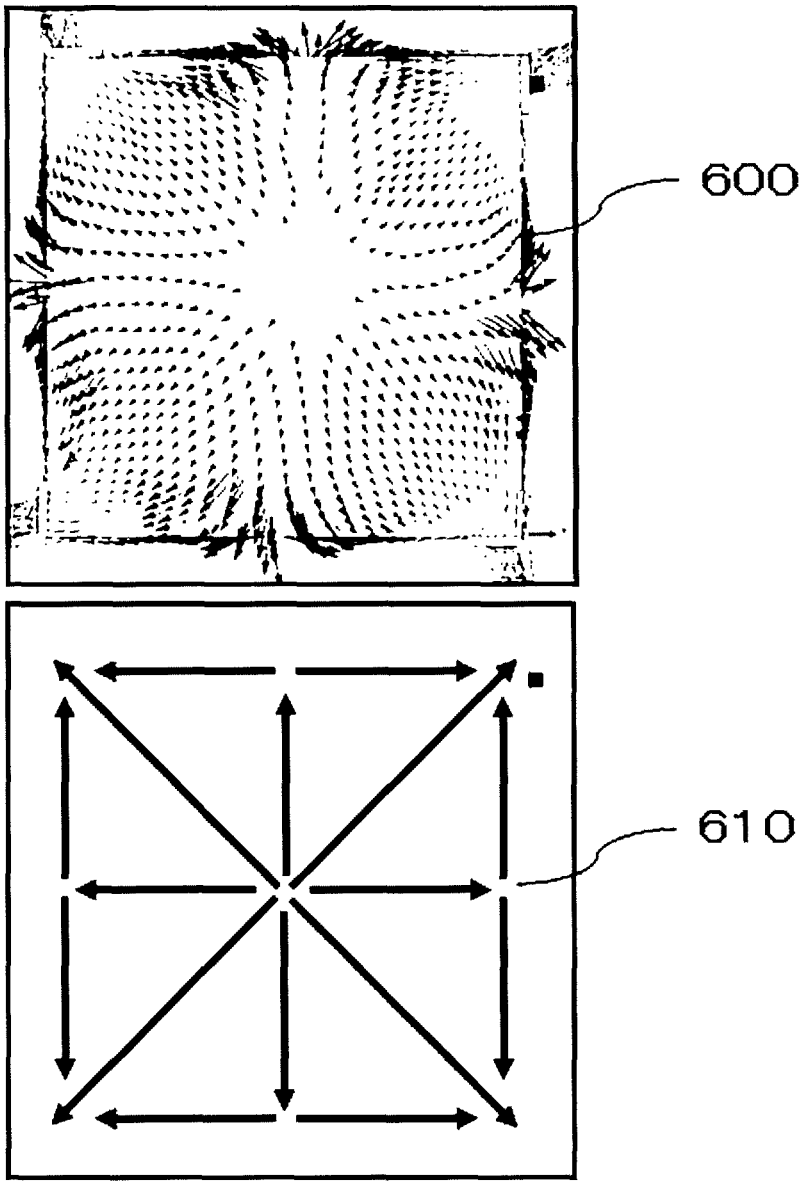
FIG. 6 is a diagram illustrating a current distribution of a top surface part in a case of an embodiment categorized into a loop antenna.

FIG. 6 is a diagram illustrating a current distribution of the top surface part in a case of an embodiment categorized into a loop antenna. A description will be given of the current distribution for a case in which the current flows in the antenna device having the structure illustrated in FIG. 3, in place of the case illustrated in FIG. 5, by referring to FIG. 6. In the case of this structure, the current flows from the central part of the top surface part towards the side surface opening, as illustrated by a distribution 600 in FIG. 6, and an operating length exhibits an increase despite the small size. More particularly, as illustrated by a distribution 610, parts where the arrows cancel each other decreases compared to the case illustrated in FIG. 5, and the current distribution is uniform as a whole.

The feeding point is arranged at a position on the top surface of the structure described above to operate the antenna device as the slot antenna. On the other hand, in one embodiment, the feeding point is arranged at 1 leg part to operate the antenna device as the deformed loop antenna, to thereby improve an efficiency of the current, and consequently reduce the size and thickness.

Figure 7:
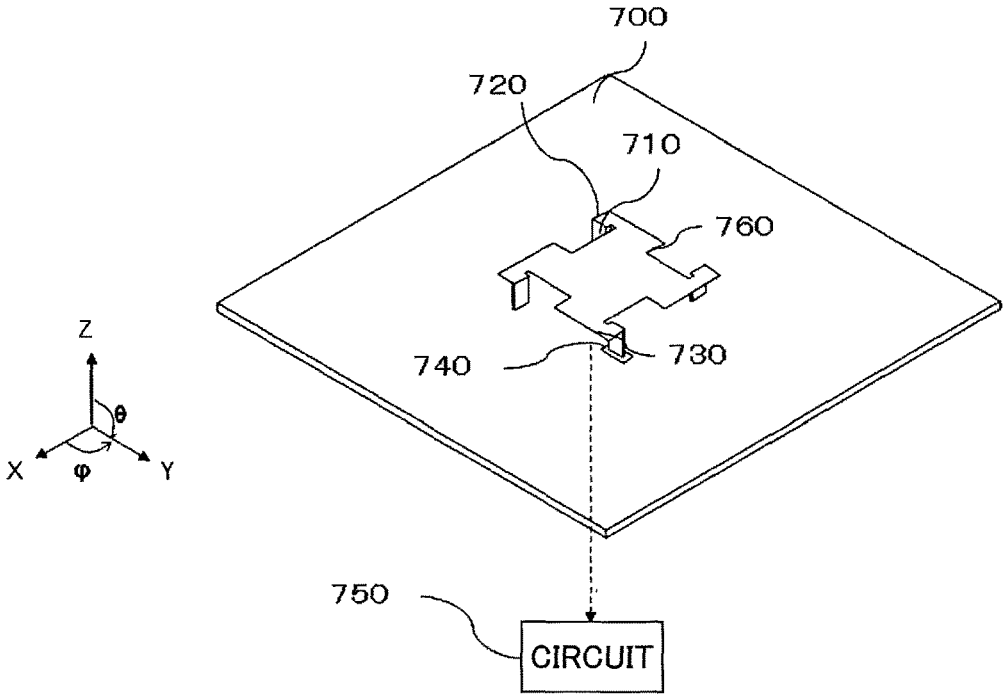
FIG. 7 is a diagram for explaining an antenna device in one embodiment of the present invention having a cutout shape at an outer side.

FIG. 7 is a diagram for explaining an antenna device in one embodiment of the present invention having a cutout shape at an outer side. FIG. 7 illustrates the antenna element 210 illustrated in FIG. 3 having the outer side with the cutout shape. The antenna device illustrated in FIG. 7 has a plate-shaped wiring board 700 that is grounded, a plate-shaped antenna element 710 that is arranged to oppose the wiring board 700 with a gap formed therebetween, 3 grounding leg parts 720 arranged at end parts of the antenna element 710 and having respective extending tips connected to the wiring board 700, and a feeding leg part 730 arranged at an end part of the antenna element 710 and having an extending tip that connects to a circuit 750. A hole 740 is formed in the wiring board 700 at a part to which the feeding leg part 730 extends, and the feeding leg part 730 passes through the surface of the wiring board 700 so as not to make contact with a grounding part of the wiring board 700.

In addition to the structure described above, the antenna device illustrated in FIG. 7 further has a cutout part 760 having the cutout shape that is formed by cutting out at least a part of an outer side part connecting between the end parts where 2 adjacent leg parts, among the plurality of grounding leg parts 720 and the feeding leg part 730 of the antenna element 710, are arranged. The plurality of grounding leg parts 720 and the feeding leg part 730 connect to the wiring board 700 and the circuit 750, respectively, via the extending tips of the outer side part other than the cutout parts.

The cutout parts 760 are parts cut out from the antenna element 710. The antenna element 710 that is not cut out and not having the cutout parts 760 has the same structure as the antenna device illustrated in FIG. 3. The shape of the cutout part 760 is a rectangular shape having one side with a length from a center point of each outer side of the antenna element 710 to a position not reaching 1 vertex in a direction towards this 1 vertex. The other side of the rectangular shape of the cutout part 760 is a part that extends vertically from the outer side part, that is, towards the gravitational center of the antenna element 710, and is shorter than the part along the outer side part.

The cutout part 760 described above is provided in each of the four sides of the antenna element 710, and as a result, the antenna element 701 as a whole has the point symmetrical structure even after the cutout parts 760 are provided.

Accordingly, the 4 cutout parts 760 are arranged to be point symmetrical as a whole. In a case in which one cutout part 760 is arranged at a position to the left on the outer side, the other 3 cutout parts 760 are also arranged at positions to the left on the respective outer sides, so that the point symmetrical structure is obtained as a whole. Because it is sufficient to obtain the point symmetrical structure as a whole, the outer side after being cut out may have a further extended structure, or a shortened structure. A suitable structure is selected to obtain desired current distribution and field distribution.

Figure 8:
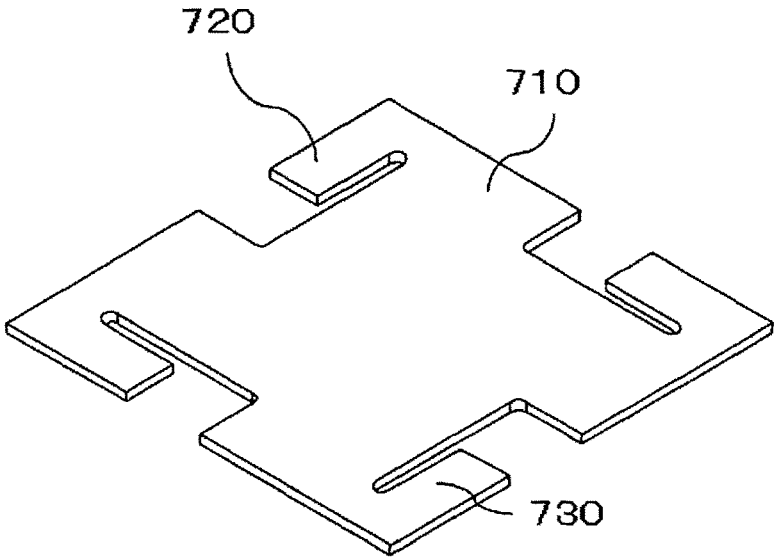
FIG. 8 is a diagram illustrating a structure of the antenna device in one embodiment of the present invention before assembly.

FIG. 8 is a diagram illustrating a structure of the antenna device in one embodiment of the present invention before assembly. FIG. 7 illustrates an arrangement relationship of the antenna device including the antenna element 710. The shape for forming the antenna element 710 illustrated in FIG. 7 will be described, by referring to FIG. 8. Of course, 4 locations of the square antenna element 210 illustrated in FIG. 3 may be cut out to further arrange the leg parts, however, as illustrated in FIG. 8, a portion of the cutout part 760 extending from a part near the vertex may have a structure that is not cut out. In this case, 3 parts extending from the vertexes form the grounding leg parts 720, respectively, and 1 other part extending from the vertex forms the feeding leg part 730. These leg parts may be arranged as illustrated in FIG. 7 by bending each of these leg parts at right angles.

Figure 9:
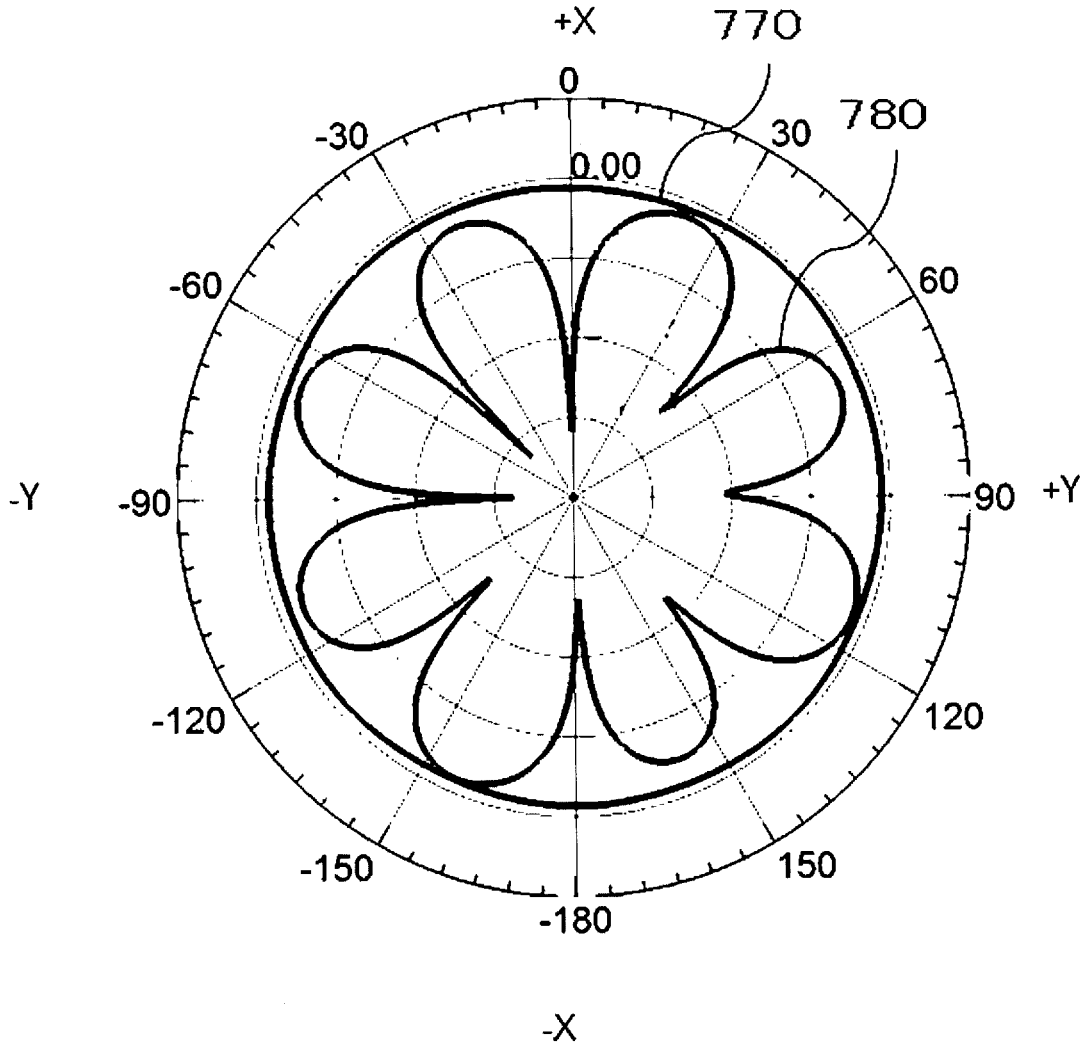
FIG. 9 is a diagram for explaining a radiation characteristic of an antenna device in one embodiment of the present invention having a cutout.

The antenna device illustrated in FIG. 7 also basically operates as a deformed loop antenna of approximately 1λ, and the vertical polarization antenna device having the nondirectional radiation characteristic can be obtained similarly as in the case of FIG. 1. FIG. 9 is a diagram for explaining the radiation characteristic of the antenna device in one embodiment of the present invention having a cutout. A waveform 770 indicates the vertical polarization, and a waveform 780 indicates a horizontal polarization.

In the case of an antenna operating at 5.9 GHz, for example, a volume forming an antenna element may be determined by the square having a side of 15.8 mm and forming the antenna element 710, and each leg part having a height of 4 mm. The size of the antenna device can be reduced compared to the conventional structure of the antenna device. By faulting a slit or a bent side that forms a bypass for a high-frequency current, the size of a projected area of the antenna can be reduced while maintaining the radiation characteristic and the operating frequency of the antenna.

Figure 10:
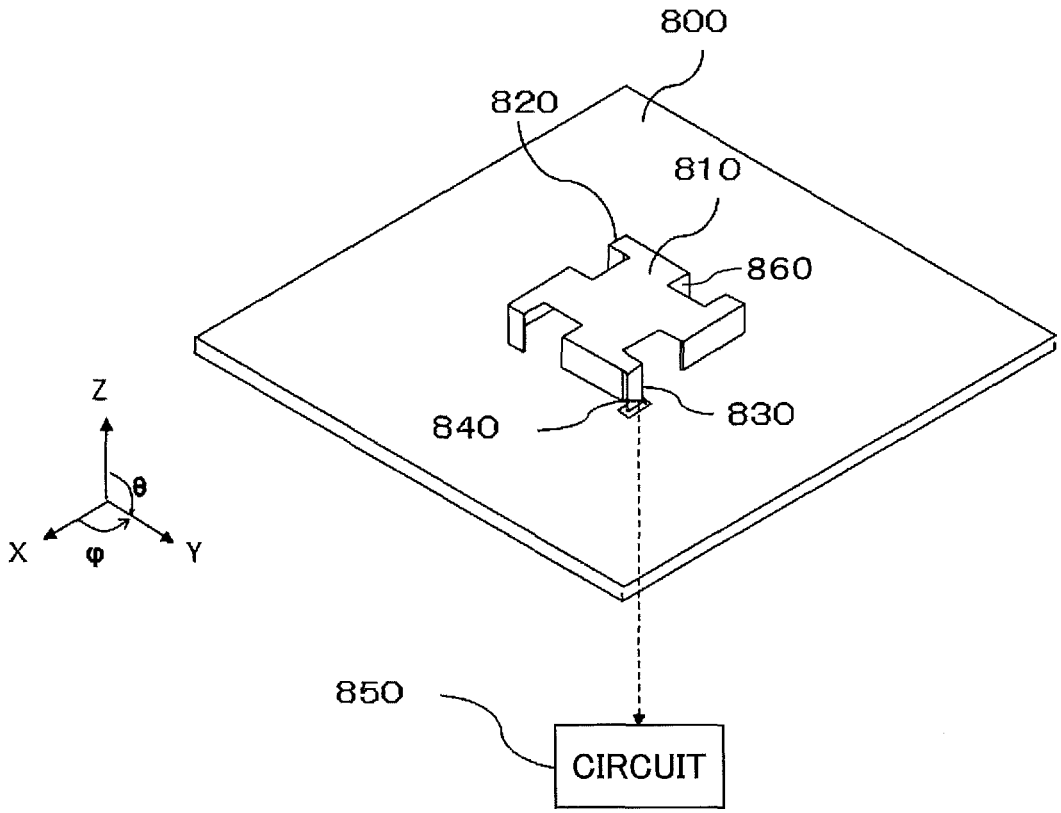
FIG. 10 is a diagram for explaining a second antenna device in one embodiment of the present invention having the cutout shape at the outer side and a leg part with a width.

FIG. 10 is a diagram for explaining a second antenna device in one embodiment of the present invention having the cutout shape at the outer side and a leg part with a width. FIG. 7 illustrates the antenna device provided with the cutout parts 760. On the other hand, the antenna device illustrated in FIG. 10 further has widened leg parts. The antenna device illustrated in FIG. 10 has a plate-shaped wiring board 800 that is grounded, a plate-shaped antenna element 810 that is arranged to oppose the wiring board 800 with a gap formed therebetween, 3 grounding leg parts 820 arranged at end parts of the antenna element 810 and having respective extending tips connected to the wiring board 800, and a feeding leg part 830 arranged at an end part of the antenna element 810 and having an extending tip that connects to a circuit 850. A hole 840 is formed in the wiring board 800 at a part to which the feeding leg part 830 extends, and the feeding leg part 830 passes through the surface of the wiring board 800 so as not to make contact with a grounding part of the wiring board 800.

Figure 11:
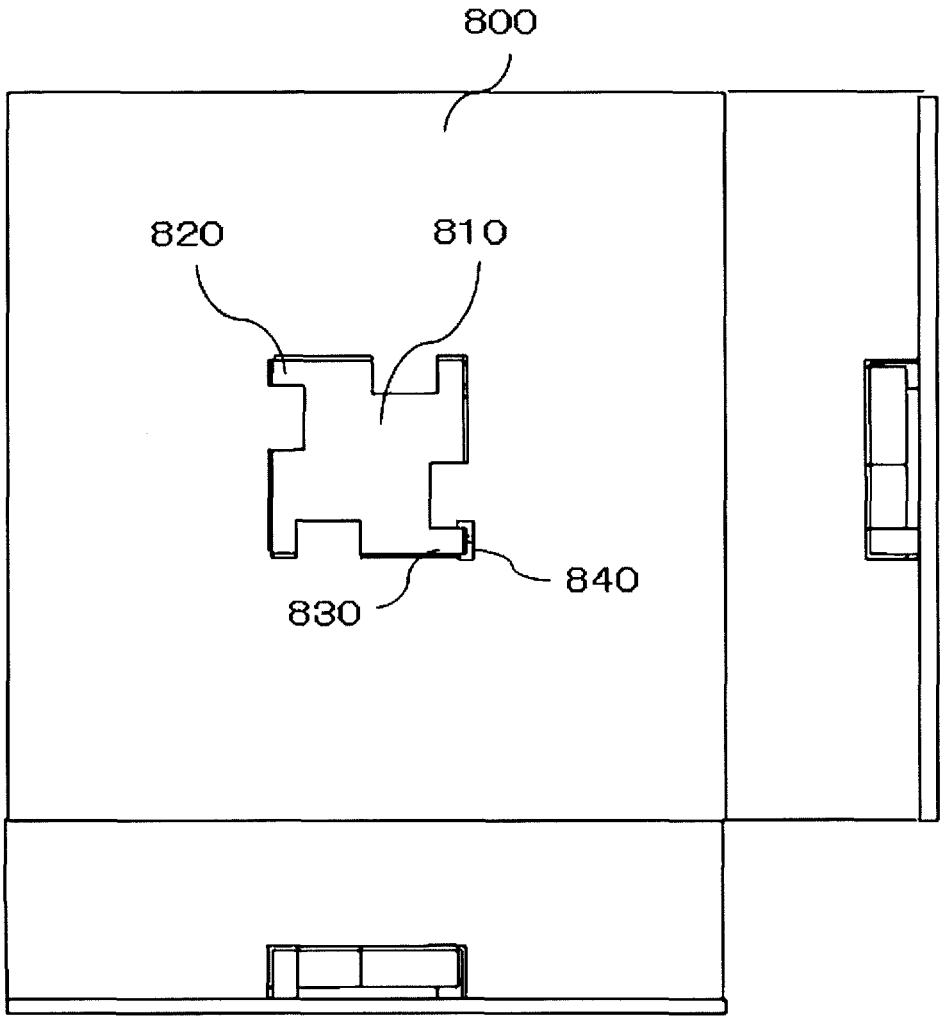
FIG. 11 is a diagram illustrating the second antenna device in one embodiment of the present invention having the cutout shape at the outer side and the leg part with the width, viewed from a top and a side.

FIG. 11 is a diagram illustrating the second antenna device in one embodiment of the present invention having the cutout shape at the outer side and the leg part with the width, viewed from a top and a side.

In addition to the structure described above, the antenna device further has a cutout part 860 having the cutout shape that is formed by cutting out at least a part of an outer side part connecting between the end parts where 2 adjacent leg parts, among the plurality of grounding leg parts 820 and the feeding leg part 830 of the antenna element 810, are arranged. The plurality of grounding leg parts 820 and the feeding leg part 830 connect to the wiring board 800 and the circuit 850, respectively, via the extending tips of the outer side part other than the cutout parts.

The structure of the antenna device illustrated in FIG. 10 is basically the same as the structure of the antenna device illustrated in FIG. 7, except that the leg parts are formed into a sheet shape. According to this structure, the leg parts is stable, and the antenna device as a whole is structurally stable. In addition, because a volume of the antenna element and the grounding surface is large, it is possible to further reduce the overall size of the antenna device.

Figure 12:
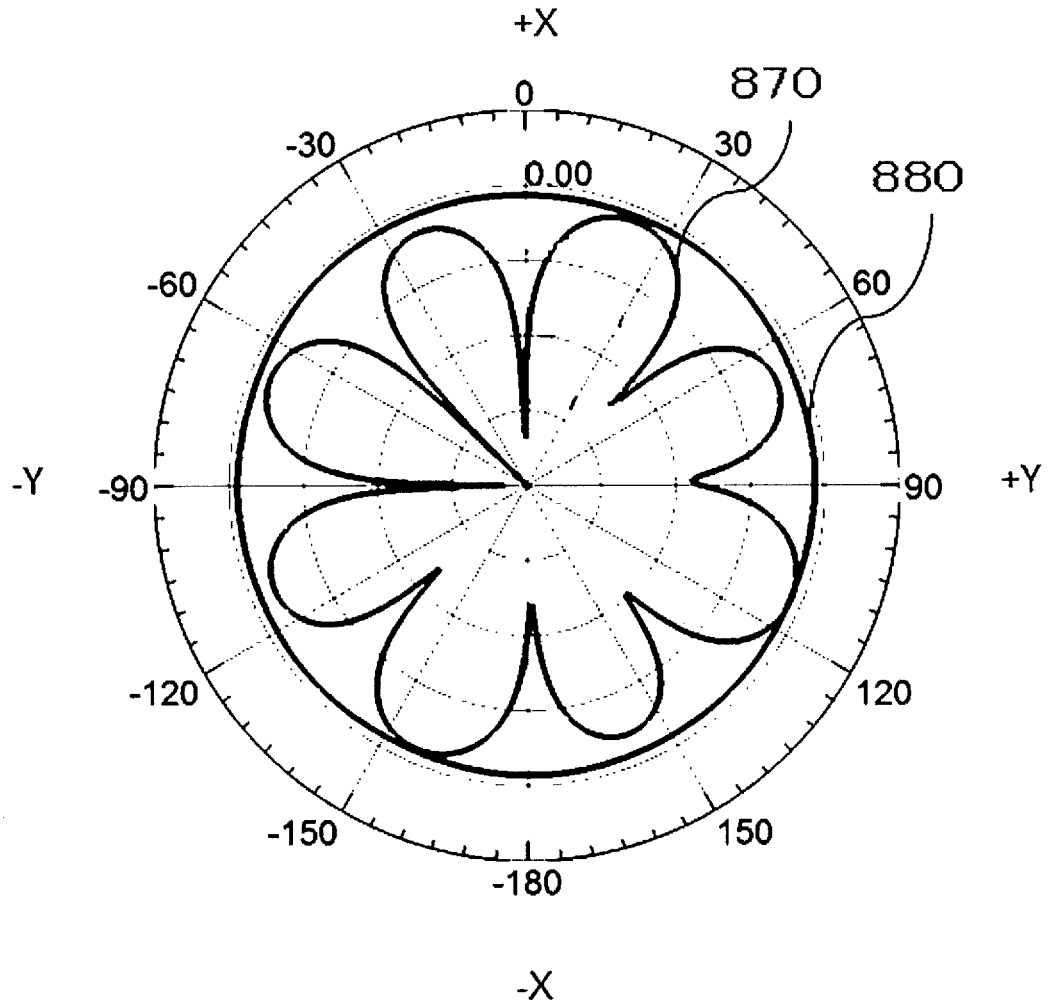
FIG. 12 is a diagram for explaining a radiation characteristic of the second antenna device in one embodiment of the present invention having a cutout.

The antenna device illustrated in FIG. 10 also basically operates as a deformed loop antenna of approximately 1λ, and the vertical polarization antenna device having the nondirectional radiation characteristic can be obtained similarly as in the case of FIG. 1. FIG. 12 is a diagram for explaining the radiation characteristic of the second antenna device in one embodiment of the present invention having a cutout. A waveform 870 indicates the vertical polarization, and a waveform 880 indicates a horizontal polarization. In the case of an antenna operating at 5.9 GHz, for example, a volume forming an antenna element may be determined by the square having a side of 15 mm and forming the antenna element 810, and each leg part having a height of 4 mm. The size of the antenna device can be reduced compared to the conventional structure of the antenna device.

A description is given above for a case in which the point symmetrical structure is employed and one of the leg parts is used for feeding in place of grounding, by referring to each of the figures. According to this structure, power is fed from one end of the point symmetrical shape and grounded at the other end, and since the point symmetrical structure is used to perform the loop operation by a rotation symmetric current distribution, it is possible to avoid a situation in which the current is canceled in a complicated manner. As a result, an operating length having a suitable size can be secured, and the size of the antenna device can be reduced while securing the size of the operating length.

The present invention is not limited to the embodiments described above. In other words, various modifications, combinations, sub-combinations, and substitutions may be made by those skilled in the art on constituent elements of the embodiments described above, within a technical scope or within a range of equivalence of the present invention. Although the present invention is described by referring to the above embodiments, the present invention is not limited to the above embodiments, and improvements and modifications may be made for the purposes of improvements or within the scope of the present invention.

For example, in the embodiments described above, the described examples of the antenna devices have 2 or 3 grounding leg parts, however, 4 or more grounding leg parts may be provided.

As described above, the present invention is useful in antenna devices for vehicles, but the present invention is not limited to the antenna device for use in vehicles and is also applicable to antenna devices for use in various applications.

According to the embodiments described above, it is possible to provide an antenna device that can further reduce the size of a nondirectional vertical polarization antenna.

For example, a plane formed by the end parts where the plurality of grounding leg parts are arranged, and the end part where the feeding leg part is arranged, is point symmetrical. According to this structure, power is fed from one end of the point symmetrical shape and grounded at the other end, and since the point symmetrical structure is used to perform the loop operation by a rotation symmetric current distribution, it is possible to avoid a situation in which the current is canceled in a complicated manner. As a result, an operating length having a suitable size can be secured, and the size of the antenna device can be reduced while securing the size of the operating length.

A surface of the antenna element opposing the wiring board may have a regular polygonal shape, the end part where the feeding leg part is arranged may be one of vertexes of the regular polygonal shape, and the end parts where the plurality of grounding leg parts are arranged may be other of the vertexes of the regular polygonal shape. According to this structure, the point symmetrical structure of the antenna element can be obtained with a simple structure, using a shape that is easy to design and manufacture.

The antenna device may further include a cutout part having a cutout shape that is formed by cutting out at least a part of an outer side part connecting between the end parts where 2 adjacent leg parts, among the plurality of grounding leg parts and the feeding leg part of the antenna element, are arranged, wherein the plurality of grounding leg parts and the feeding leg part connect to the wiring board and the transmission circuit or the reception circuit, respectively, via the extending tips of the outer side part other than the cutout parts. According to this structure, the cutout part is provided in the shape that causes the current distribution to loop due to the point symmetrical structure. Hence, the cutout part causes meandering of the current which otherwise flows in a periphery of the outer side part, and as a result, a current path can further be secured, and the size of the antenna device can further be reduced.

The plurality of grounding leg parts and the feeding leg part may respectively have a sheet shape extending from a portion of the outer side part that is not cut out. According to this structure, because the grounding leg parts and the feeding leg part are close to the wiring board, the grounding is made so that the volume of the antenna element and the grounding surface is large, to thereby further reduce the size of the antenna device.

A surface of the antenna element opposing the wiring board may have a regular triangular shape or a square shape. According to this structure, the square shape enables the size of the antenna device to be easily reduced, and the antenna device to be easily manufactured.

A surface of the antenna element opposing the wiring board, before cutting out the outer side part, may have a regular triangular shape or a square shape. According to this structure, the meandering of the current can be caused based on the shape that is easily manufactured, to thereby reduce the size of the antenna device.

The antenna device may further include the wiring board, wherein the wiring board is plate-shaped. According to this structure, a nondirectional vertical polarization antenna can be obtained from a combination of the antenna element and the wiring board.

What is claimed is:

1. An antenna device comprising:

a plate-shaped antenna element arranged to oppose a wiring board that is grounded, with a gap formed between the antenna element and the wiring board;

a plurality of grounding leg parts arranged at respective outer side parts of the antenna element and having respective extending tips connected to the wiring board;

a feeding leg part arranged at a corresponding outer side part of the antenna element and having an extending tip that connects to a transmission circuit or a reception circuit;

a plurality of rectangular cutout parts respectively formed at the outer side parts of the antenna element and extending toward an inner side of the antenna element; and a plurality of sidewall parts respectively arranged at the outer side parts of the antenna element and extending toward the wiring board, wherein the antenna element includes a surface opposing the wiring board and having a regular polygonal shape in a plan view, a plurality of corner parts respectively corresponding to vertexes of the regular polygonal shape, and a plurality of side parts respectively corresponding to sides of the regular polygonal shape, wherein each of the side parts is arranged between two adjacent corner parts, and has a first portion closer to one of the two adjacent corner parts and a second portion closer to the other of the two adjacent corner parts, wherein the feeding leg part is arranged at one of the corner parts of the antenna element, and the plurality of grounding leg parts are arranged at remaining corner parts of the antenna element, wherein each of the plurality of rectangular cutout parts is formed at the first portion of the side part, and wherein each of the plurality of sidewall parts is formed at the second portion of the side part.

2. The antenna device as claimed in claim 1, wherein the regular polygonal shape of the surface of the antenna element is a square shape in the plan view, and the plurality of leg parts, the feeding leg part, the plurality of rectangular cutout parts, and the plurality of sidewall parts are located at rotationally symmetric positions.

3. The antenna device as claimed in claim 1, further comprising:

the wiring board, wherein the wiring board is plate-shaped.

4. The antenna device as claimed in claim 3, wherein the wiring board includes a hole, and a grounding part, and the extending tip end of the feeding leg part passes through the hole in the wiring board so as not to make contact with the grounding part of the wiring board.

5. The antenna device as claimed in claim 1, wherein the regular polygonal shape of the surface of the antenna element is a square shape in the plan view, and the plurality of grounding leg parts and the feeding leg part are located at rotationally symmetric positions.

6. The antenna device as claimed in claim 5, wherein the plurality of sidewall parts are located at rotationally symmetric positions.

7. The antenna device as claimed in claim 5, wherein the plurality of rectangular cutout parts are located at rotationally symmetric positions.

* * * * *